United States Patent [19]

Fukuzawa et al.

[11] Patent Number: 4,920,661

[45] Date of Patent: May 1, 1990

[54] DEHYDRATING MACHINE

[75] Inventors: Sooichi Fukuzawa, Hitachi; Tamotu Shikamori, Ibaraki, both of Japan

[73] Assignee: Hitachi, Ltd., Tokyo, Japan

[21] Appl. No.: 253,575

[22] Filed: Oct. 5, 1988

[30] Foreign Application Priority Data

Oct. 9, 1987 [JP] Japan ..... 62-253774

[51] Int. Cl.[5] ..... F26B 17/30

[52] U.S. Cl. ..... 34/58; 34/133; 210/380.2; 210/381

[58] Field of Search ..... 34/58, 133, 158; 210/380.2, 381, 377, 373

[56] References Cited

U.S. PATENT DOCUMENTS 3,277,583 10/1966 Mack ..... 34/58

FOREIGN PATENT DOCUMENTS 619878 3/1986 Japan .

*Primary Examiner*—Henry A. Bennet
*Assistant Examiner*—John Sollecito
*Attorney, Agent, or Firm*—Antonelli, Terry & Wands

[57] ABSTRACT

A washing/dehydrating machine performing a centrifugal dehydration by rotating a washing/dehydrating tub having a plurality of discharging ports in high speed comprises a plurality of protrusions protruded toward inwardly formed on an inner surface of the washing-/dehydrating tub. A total volume of the protrusions is determined in a range of 3% to 6% of capacity of the washing/dehydrating tub. A water saturated region in the wash is reduced by an amount of volume corresponding to the total volume of the protrusions.

6 Claims, 5 Drawing Sheets

DEHYDRATING MACHINE

BACKGROUND FO THE INVENTION

The invention relates to a dehydrating machine and, more particularly, to a dehydrating tub having an improved dehydrating performance.

A washing and dehydrating tub of a type wherein water is discharged from an upper portion of the tub has been proposed; however, a disadvantage of this proposed dehydrating tub resides in the fact that, during dehydration, washing is pressed against a wall of the dehydrating tub thereby hindering a flow of water toward the upper portion of the tub.

To avoid the above-noted disadvantage, in, for example, Japanese Patent Examined Publication 61-9878, a dehydrating tub is proposed wherein a wall thereof is tapered toward a bottom of the tub, with a plurality of grooves extending in a vertical direction being formed in an inner surface of the wall so that, in use, water is collected in the vertically extending grooves and flows toward the upper portion of the tub.

While proposals have been advanced for improving the dehydrating performance paying attention only to the inner surface of the wall of the dehydrating tub no attention has been given to the whole structure of the dehydrating tub with respect to the improvement of the dehydrating performance. As a result, the dehydrating performance of the prior art dehydrating machine is unsatisfactory and the water is not sufficiently dehydrated from the washing. Since the dehydration process reaches a stable condition, when a centrifugal force g and a capillary height Hs of the water (a water saturation region) based on a capillary action of the washing are balanced, so that the dehydration does not proceed.

SUMMARY OF THE INVENTION

The invention is achieved as a result of study of a relationship between whole configuration of the dehydrating tub and dehydrating ratio when a rotational speed of the dehydrating tub is increased.

The aim underlying the invention essentially resides in providing an improved dehydrating machine having an improved dehydrating performance, so as to shorten the necessary time period for a complete dehydration.

A dehydrating machine according to the invention performing a centrifugal dehydration by rotating a dehydrating tub having a plurality of dehydrating ports in high speed with a plurality of inwardly directed protrusions being formed on an inner surface of a wall of the dehydrating tub. A total volume of the protrusions is preferably in a range of 3 to 6% of a capacity of the dehydrating tub.

By virtue of the above-noted features of the present invention, the water saturation region in the vicinity of the wall of the dehydrating tub, that is, a volume of water not dehydrated and remaining in the washing is less than that of the prior art dehydrating machine.

DESCRIPTION OF THE PREFERRED EMBODIMENTS

Figure 2:
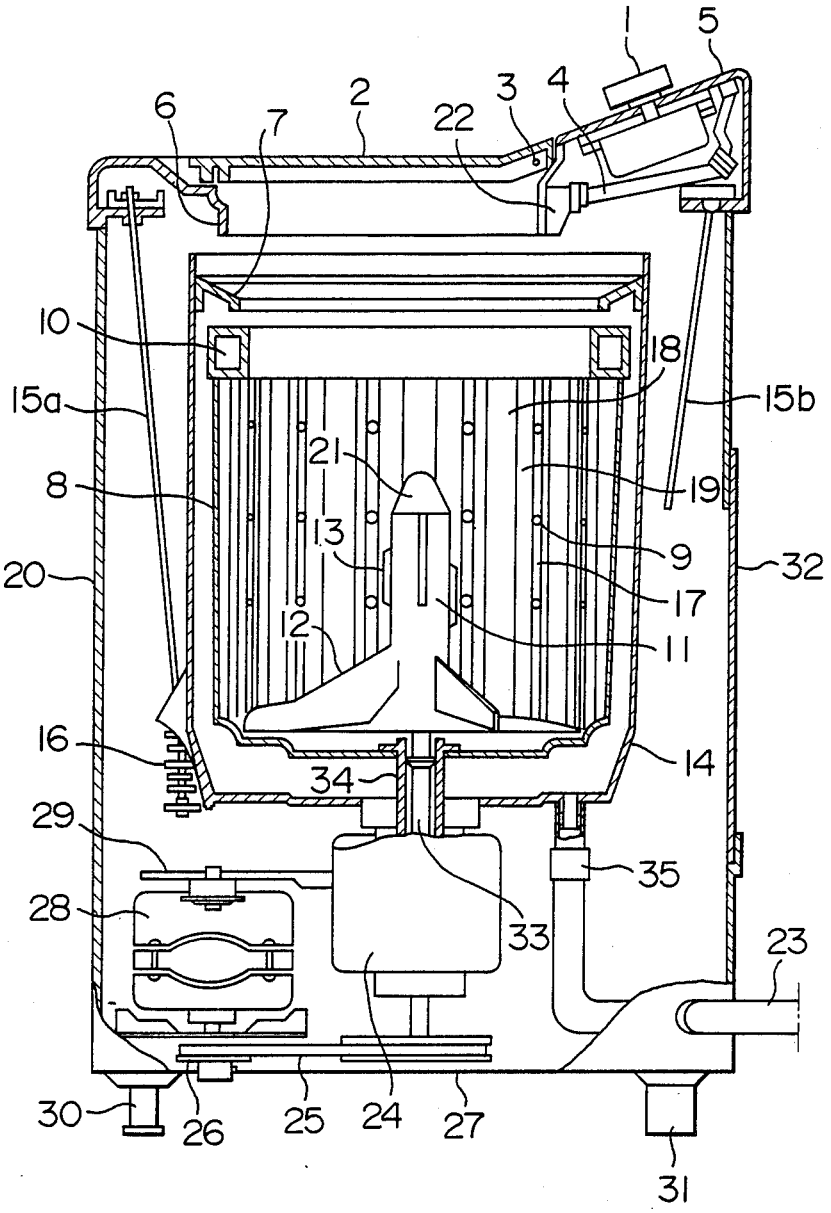
FIG. 2 is a vertical sectional view of an embodiment of a dehydrating machine according to the invention.
Figure 3:
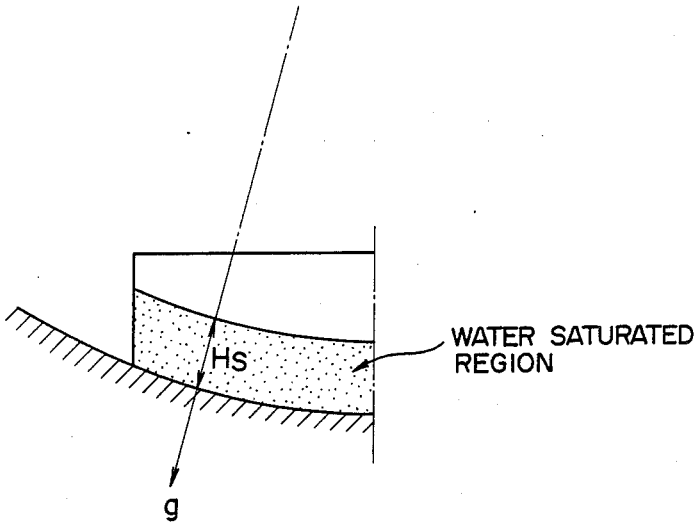
FIG. 3 is a view to explain dehydrating principle of a prior art dehydrating tub.

Referring now to the drawings wherein like reference numerals are used throughout the various views to designate like parts and, more particularly, to FIG. 2, according to this figure, a dehydrating tub in accordance with the present invention may be employed in, for example, a fully automatic washing machine including a timer 1 for controlling the washing machine, a lid 2 upwardly openable about a pivot axis 3, a communicating tube 3 communicating with a connecting portion of a water supplying tube (not shown) and a water supplying portion 22, a dehydrating tub 8, and an outer tub 14. An opening 6 is provided for enabling a load of wash to be placed in the washing machine, with a cover 7 being provided on an upper portion of the outer tub 14 for preventing the wash from falling between the dehydrating tub 8 and the outer tub 14.

A plurality of dehydrating ports 9 discharge water during dehydration and are formed in a plurality of vertically extending valley grooves 17 formed in a wall surface of the dehydrating tub 8. A balance ring 10 enables a smooth rotation of the dehydrating tub 8 upon a dehydrating operation of the washing machine. An agitator 11 disposed in the dehydrating tub 8, with the agitator 11 including a main blade 12, small blades 13 and a cap 21. The washing machine further includes an outer frame 20 and a back lid 32, with a shaft 33 being provided for transferring power from a motor 28 through belts 25, a motor pulley 26, a driven pulley 27 and a clutch/transmission 24 to the agitator 11. A hollow shaft 34 transfers the power of the motor 28 to the dehydrating tub 8 during a dehydration operation. A stay 29 supports the motor 28 with feet 30, 31 supporting the washing machine, and with protrusions 18, 19 being provided on the inner surface of the wall of the dehydrating tub 8. A discharge valve 35 is adapted to be and opened and closed by a command signal from a controller (not shown) to discharge water through a drain tube 23 to an exterior of the dehydrating tub 8. Hanging rods 15*a*, 15*b* are provided for hanging the outward tub 14 through springs 16.

Figure 1:
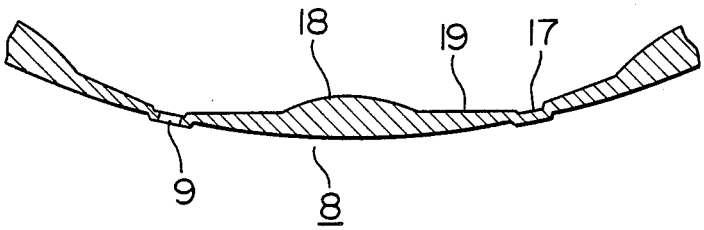
FIG. 1 is a horizontal sectional view of a portion of an embodiment of a dehydrating tub according to the invention.
Figure 7:
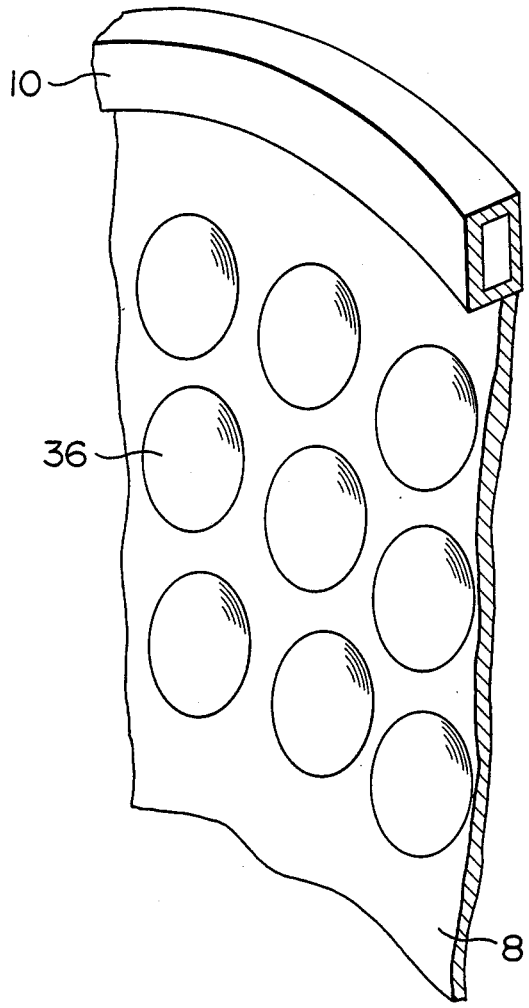
FIG. 7 is a perspective view of a portion of another embodiment of a dehydrating tub of the invention.

The protrusions 18, 19 are formed by vertically extending ribs which have a horizontal cross-section shown most clearly in FIG. 1. However, in lieu of the protrusions 18, 19, as shown most clearly in FIG. 7, the dehydrating tub may be provided with hemispherical protrusions 36 on the inner surface of the dehydrating tub 8.

Figure 4:
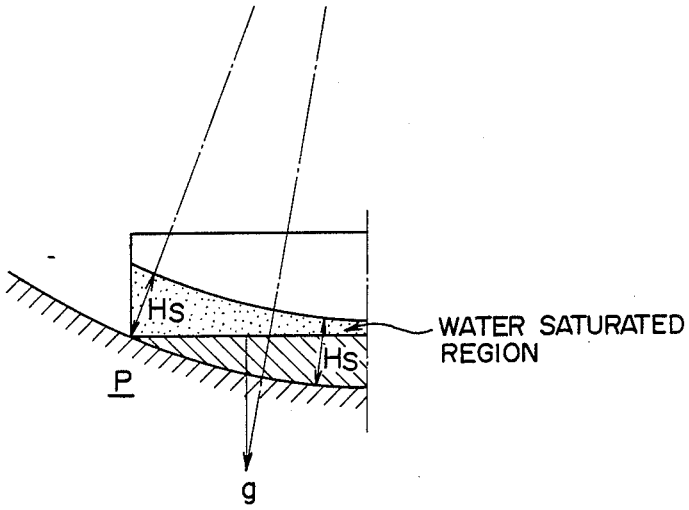
FIG. 4 is a view to explain dehydrating principle of the dehydrating tub of the invention.

During an initial state of the dehydrating operation, a considerable amount of water is discharged from the dehydrating ports 9 to the exterior of the dehydrating tub 8. Then, in non-steady state of the dehydrating operation, that is, in a state of the dehydrating process until the water saturated region Hs is formed in the wash, water films are formed on surfaces of the protrusions 18, 19 which obliquely intersect a direction of centrifugal force g, so that the water in the wash flows through the water films to be collected at points P at the futherest ends of the protrusions. As a result, the water saturated region Hs in the wash is reduced by an amount of a volume corresponding to the total volume of the protrusions as shown in FIG. 4, that is, the water in the wash is more dehydrated and the dehydrating performance is improved.

Figure 5:
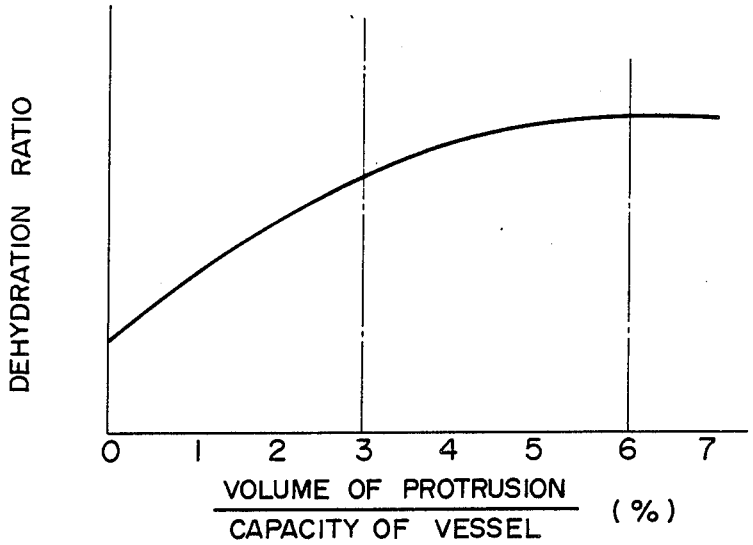
FIGS. 5 and 6 are graphs to show dehydrating effects of the invention.
Figure 6:
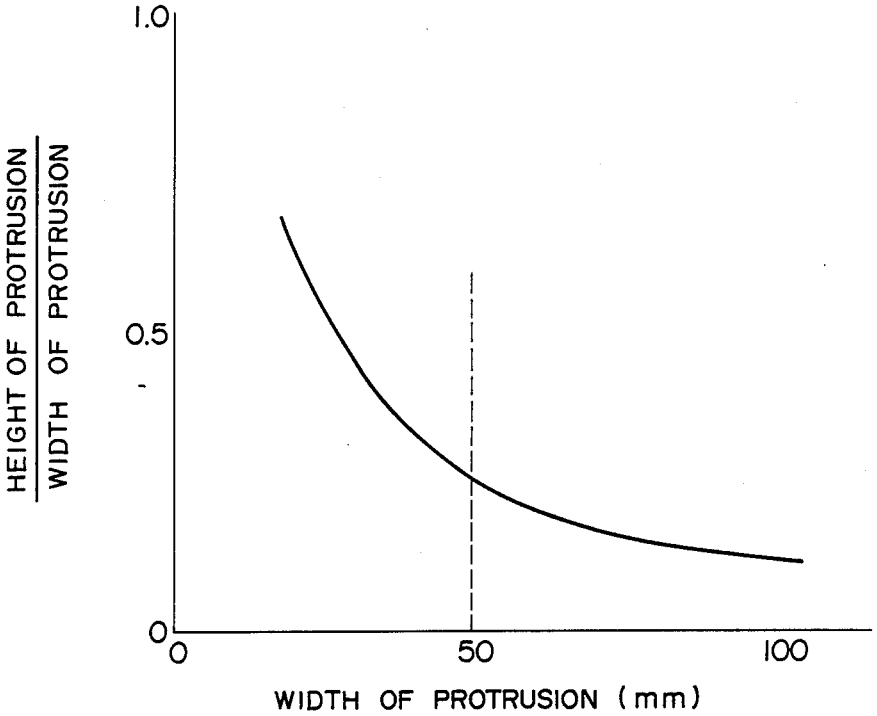

FIG. 5 shows a result of an experiment showing a relationship between a dehydrating ratio and (total volume of protrusions/capacity of the dehydrating tub) when the dehydrating tub is rotated at 800 r.p.m.. As apparent from FIG. 5, the dehydrating ratio is impractically low when the total volume of the protrusions is less than 3% of the capacity of the dehydrating tub and the dehydrating ratio is saturated when the total volume of the protrusions is more than 6% of the capacity of the dehydrating tub. Thus, any increase in the total volume of the protrusions beyond 6% does not produce any remakable effect of the dehydration and, on the contrary, a capacity of the dehydrating tub available for accommodating the washing is undesirably decreased. For this reason, in the invention, the total volume of the protrusions is determined in a range of 3 to 6% of the capacity of the dehydrating tub.

Where a width of the protrusions is small when the volume of the protrusion is a constant, a ratio of height of the protrusion relative to the width become large. As a result, the wash in the dehydrating tub may not be in completely close contact with the wall of the dehydrating tub by a configuration of the protrusion or a relation between adjacent protrusions. FIG. 6 shows a relationship between the width and height of the protrusion when the volume of the protrusion is a constant and it will be understood therefrom that slope of the protrusion becomes gradual if the width of the protrusion is more than 50 mm. It has been experimentally determined, that the wash closely contacts the surface of the protrusion when the width of the protrusion is more than 50 mm. Accordingly, in the invention, the width of the protrusion is determined more than 50 mm.

As will be understood from the foregoing description, according to the invention, a volume of the water saturated region in the wash, i.e., an amount of the water remaining in the wash is more reduced than the prior art dehydrating machine. Thus, an improved dehydrating machine which has an improved dehydrating performance and which can shorten the dehydrating time period.

What is claimed is:

1. A dehydrating machine for performing a centrifugal dehydration by a high speed rotation of a dehydrating tub having a plurality of dehydrating ports, wherein the dehydrating tub includes a plurality of inwardly directed circumferentially spaced protrusions formed on an inner surface of a wall of the dehydrating tub, and wherein a total volume of the plurality of imperforate protrusions is in a range of 3 to 6% of a total volume of the dehydrating tub.

2. A dehydrating machine as claimed in claim 1, wherein the protrusions have a width of more than 50 mm.

3. A dehydrating machine as claimed in claim 1, wherein the protrusions extend in a vertical direction of the dehydrating tub.

4. A washing/dehydrating machine comprising a washing/dehydrating tub having discharge ports, agitator means rotatably provided in the washing/dehydrating tub, motor means for rotating the agitator means and the washing/dehydrating tub for performing a washing operation by rotating the agitator means upon washing and a centrifugal dehydration by high speed rotating of the agitator means and the washing/dehydrating tub together, and a plurality of circumferentially spaced imperforate protrusions formed on an inner surface of the washing/dehydrating tub, and wherein a total volume of the protrusions is in a range of 3 to 6% of a total volume of the washing/dehydrating tub.

5. A washing/dehydrating machine as claimed in claim 4, wherein said protrusions extend in a vertical direction of the washing/dehydrating tub.

6. A washing/dehydrating machine as claimed in claim 5, wherein said discharging ports are formed in valley portions between adjacent protrusions.

* * * * *